US005169018A

United States Patent [19]

Fiore

[11] Patent Number: 5,169,018

[45] Date of Patent: Dec. 8, 1992

[54] TACKLE BOX WITH LID-LATCHING HANDLE

[75] Inventor: Joseph F. Fiore, Lebanon, Pa.

[73] Assignee: Woodstream Corporation, Lititz, Pa.

[21] Appl. No.: 764,507

[22] Filed: Sep. 20, 1991

[51] Int. Cl.[5] ..... B65D 45/04; B65D 25/32

[52] U.S. Cl. ..... 220/318; 220/324; 220/756; 220/762; 206/315.11

[58] Field of Search ..... 220/318, 94 A, 94 R, 220/324; 206/315.11, 372

[56] References Cited

U.S. PATENT DOCUMENTS

| | | | |
|---|---|---|---|
| 144,698 | 11/1873 | Plympton . | |
| 218,304 | 8/1979 | Morgan et al. . | |
| 1,026,093 | 5/1912 | Johnson . | |
| 1,171,833 | 2/1916 | Boyle . | |
| 1,304,448 | 5/1919 | Browning . | |
| 1,312,626 | 8/1919 | Grannis | 220/318 |
| 1,722,004 | 10/1920 | Drumm . | |
| 1,761,331 | 6/1930 | Dewey | 206/372 |
| 2,047,176 | 7/1936 | Cisco . | |
| 2,320,174 | 5/1943 | Demers | 220/318 |
| 3,124,266 | 3/1964 | Morgan | 220/318 |
| 3,144,160 | 8/1964 | Johnson et al. . | |
| 3,185,338 | 5/1965 | Henning . | |
| 3,889,732 | 6/1975 | Wilkins . | |
| 3,960,289 | 6/1976 | Panicci . | |
| 3,985,409 | 10/1976 | Kneier | 312/DIG. 33 |
| 4,118,018 | 10/1978 | Gruner et al. . | |
| 4,157,763 | 6/1979 | Betlejewski et al. . | |
| 4,179,039 | 12/1979 | Kawolics . | |
| 4,351,448 | 9/1982 | Ingersoll et al. | 220/318 |
| 4,592,482 | 6/1986 | Seager . | |
| 4,673,625 | 6/1987 | McCartney et al. | 220/94 R |
| 4,691,840 | 9/1987 | Ferbrache . | |
| 4,819,827 | 4/1989 | DiSesa . | |
| 4,941,403 | 7/1990 | Cimenti . | |
| 4,982,863 | 1/1991 | Skillius . | |
| 5,044,513 | 9/1991 | Van Berne | 220/94 R |

FOREIGN PATENT DOCUMENTS

| | | | |
|---|---|---|---|
| 71846 | 5/1916 | Austria | 220/318 |
| 2352115 | 4/1975 | Fed. Rep. of Germany | 220/318 |
| 81234 | 5/1919 | Switzerland | 220/318 |

*Primary Examiner*—Stephen Marcus
*Assistant Examiner*—S. Castellano
*Attorney, Agent, or Firm*—Jacobson, Price, Holman & Stern

[57] ABSTRACT

A tackle box has a box body with a hinged lid. The box body has a deeper front portion and a shallower back portion. Correspondingly, the lid has a deeper back portion and shallower front portion. The back portion of the box body carries a stack of interconnected slidably mounted superimposed trays which can be pulled out rearwardly cantilever fashion when the lid is opened. The front portion of the box body has superimposed pull-out drawers. The box has a bail-type pivoting handle with a lid-latching mechanism which only allows the lid to open when the handle is swung forwardly from a box-carrying position. In the top of the lid, there is a removable shallow carrying case which can be used separately from the box.

3 Claims, 4 Drawing Sheets

TACKLE BOX WITH LID-LATCHING HANDLE

BACKGROUND OF THE INVENTION

This invention relates to portable containers, principally tackle boxes, but applicable also to other types of containers such as tool boxes, coolers and the like. Accordingly, while the following disclosure is directed to a tackle box in particular, this is by way of example only, and the invention is not limited thereby.

The prior art is replete with different design tackle boxes. Primary concerns in the design of such boxes are, for example, optimum usage of the available box volume consistent with strength and lightness of weight along with accessibility and effective compartmentalization for the stored items. Two of the most common types of tackle boxes are the stacked-drawer type box and the pull-out tray type box. In the former type, a significant portion of, or indeed substantially the entire box volume may be accounted for by a plurality of discrete superimposed drawers which can be opened individually from the front of the box. In the latter type, a plurality of superimposed trays are connected together by pivotal links and are lifted out of the box into a staggered cantilever-like position, commonly by means of a hinged box lid connected to the trays, access being available to each tray in the open position.

The present invention provides a tackle box having one or more of the following features namely, a novel form of pull-out tray structure; a lid-latching handle arrangement; and a removable carrying case for frequently used items.

SUMMARY OF THE INVENTION

A tackle box as herein disclosed has a main box body and a hinged lid with a swinging yoke or bail type handle hinged to opposite side walls of the box body so as to extend over the lid. The handle has a substantially vertical carrying position in which lugs on the handle arms engage over corresponding projections on opposite sides of the lid, effectively to latch or lock the lid in place. From the carrying position, the handle can be swung toward the back of the box into a transport position in which the handle lugs move along tracks and engage respective stops on the lid. Again, in this position of the handle, the engagement of the stops and lugs effectively prevents the lid from opening. To open the lid, the handle must be swung forwardly from the carrying position disengaging the lugs from the projections.

Further, in a recess on top of the lid there is provided a removable shallow carrying case with its own hinged lid. The case, which is suitable for carrying frequently-used items when it is not necessary to carry the entire box, fits into the recess by a bayonet-type fitting allowing the case to be placed in the recess from above and slid towards the back of the box to engage the bayonet fitting and hold the case in the recess. Similarly, to disengage the case, it is slid toward the front of the box, releasing the bayonet fitting and the case is then lifted from the recess.

Additionally, sitting atop the box body in the back section of the box is a stack of trays mutually interconnected by slides allowing the trays to be pulled out into an extended cantilever-like configuration when the lid is opened providing access to the individual trays and preferably also to the interior of the box body below the trays. The slides may be angled so as to separate the trays vertically when they are extended improving access to the trays.

Additional features and advantages of the invention will become apparent from the ensuring description and claims read in conjunction with the attached drawings.

DESCRIPTION OF PREFERRED EMBODIMENTS

The illustrated tackle box 10 is made predominantly from molded plastic components in a manner generally well known in the art and comprises a main box body 12, a hinged lid 14 and a swinging bail-type handle 16 with arms, as 16*a* attached to pivots, as 18, on opposite side walls of the box body, and a web 16*b* connecting the arms.

Figures 1, 2:
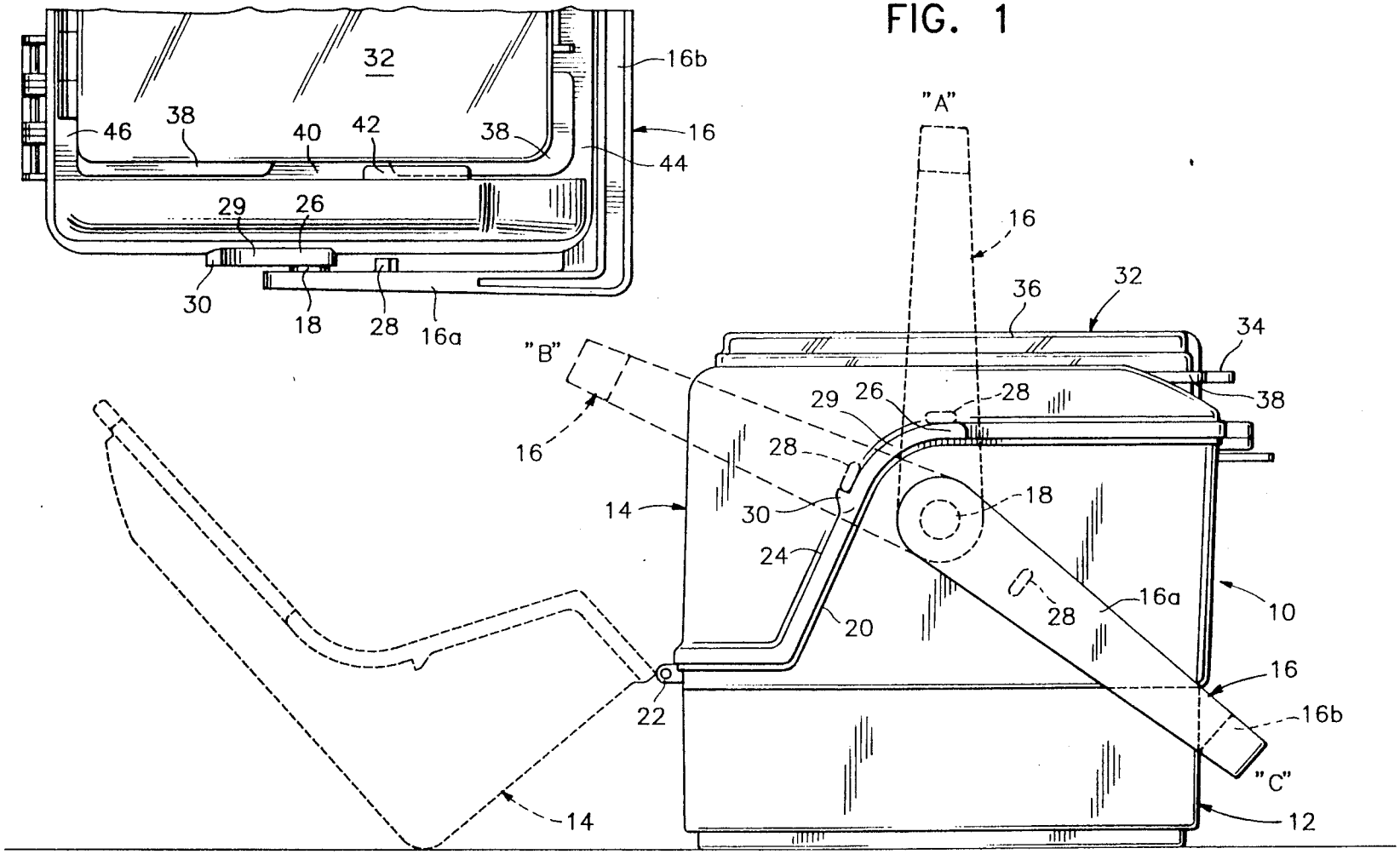
FIG. 1 is a side elevational view of a tackle box according to the invention.
FIG. 2 is a part plan view of the tackle box.
Figure 4:
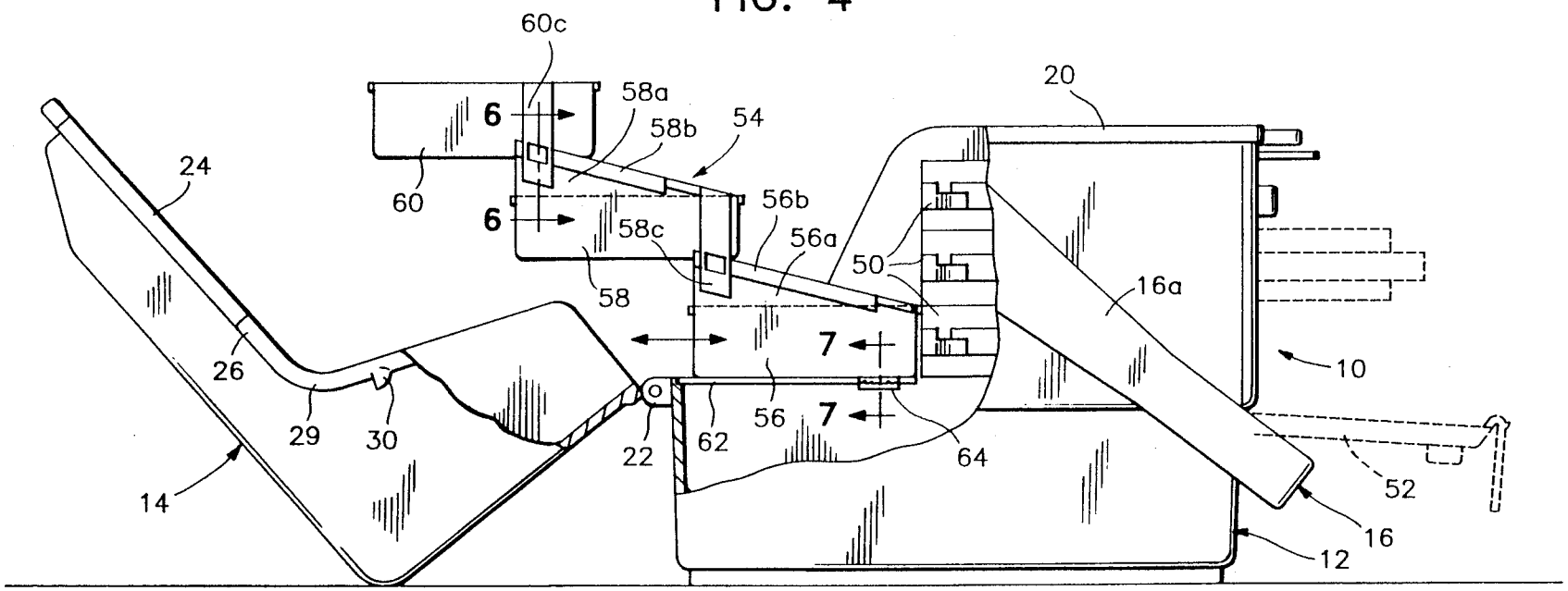
FIG. 4 is a side elevational view, part broken away and with the lid open.
Figure 8:
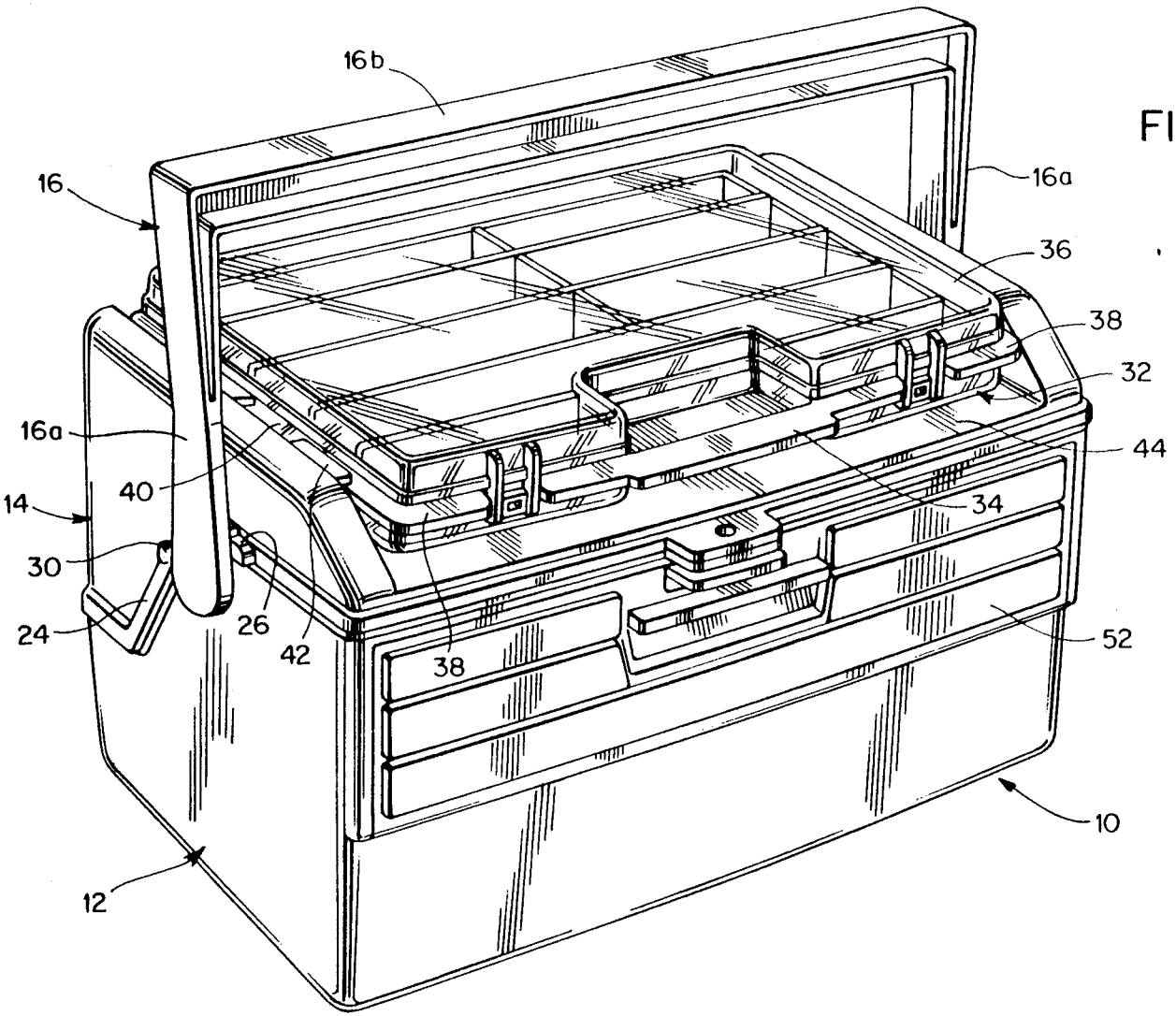
FIG. 8 is an overall perspective view of the tackle box.

As seen most clearly in FIGS. 1 and 4, the side walls of the box body have an S-shaped upper rim or flange 20 which extends downwardly from the front of the box to adjacent the lid hinge 22 at the back of the box. The side walls of the lid have an interfitting lower peripheral rim or flange 24. Incorporated in rim 24 (on each side of the box) at a location corresponding with a vertical carrying position A (FIG. 1) of the handle, is a projection 26 over which a lug 28 on the inside of handle arm 16*a* fits with a friction fit, so as to effectively prevent the lid from opening (i.e., form a lid latch) in the carrying position of the handle. Also, the lid rim 24 (on each side of the box) has a track 29 for lug 28 extending behind projection 26 and in the arc of movement of lug 28 towards the back of the box. The track terminates in a stop 30 for the handle. Thus, when the handle is moved back from the carrying position A along track 29, the lug and track interfere to prevent the lid from opening. The handle is then brought into a storage position B (where web 16*b* preferably is at or below the level of the lid) wherein the lugs 28 engage the stops 30 and prevent further backward movement of the handle. In this position of the handle, the lugs 28 are still in an interfering position with rim 24, preventing the lid from swinging open about hinge 22 and effectively maintaining the lid latching function of the handle.

In order to open the lid, it is necessary to swing the handle forwardly from the carrying position, for example to a position C in which the lugs 28 move off projections 26 and effectively clear of rim 24 to free the lid for swinging movement about the hinge.

The top of the lid 14 is recessed substantially over its entire area (although a smaller recessed area could be provided) to receive a shallow removable carrying case 32 having a fixed handle 34 and its own hinged lid 36. The carrying case fits into the lid 14 by means of a bayonet-type retention fitting comprising shallow flanges 38 around the rim of the carrying case with a gap 40 on each side (only one side is shown in the drawings) and a projecting flange 42 on each sidewall of the lid recess 44. The flanges 42 are of a length to fit in the gaps 40 and the flanges 42 are located forwardly of center relative to the front and back of lid 14. Thus, to attach the carrying case to the lid 14, the case can be placed into recess 44 from above so long as the flanges 42 are aligned with the gaps 40. With the case thus placed in the recess, the flanges 42 are located above the level of flanges 38. Accordingly, the case can be pushed back against a back wall 46 of the recess causing the front flanges 38 to move under flanges 42, with an interference fit thereby retaining the case 32 in the recess. To improve the retention of the case, suitable detent projections can be provided on the case and/or on the walls of the recess. To remove the case, it is slid forward until flanges 42 align with the gaps 40 and allow the case to be lifted from out of the lid. The case can be suitably compartmented and is suitable for carrying relatively small items when the entire tackle box is not needed.

Internally, the box body 12 has a front section 48 with a plurality of superimposed conventional-type pull-out drawers 50 and a fold-down hinged cover 52 for the drawers at the front of the box. The drawer and cover structure being conventional, no further disclosure is required herein.

The back section of the box body is provided with a stack 54 of sliding cantilever-type trays 56, 58, 60 according to a further feature of the invention. In this regard, the lowermost tray 56 is slidably mounted along horizontal flanges or runners 62 on the inner walls of the box body by way of slide elements 64, so that when the lid 14 is opened, (FIG. 4) the tray 56 can be moved inwardly and outwardly relative to the box body along the runners 62 as indicated by the two-way arrow.

The sidewalls of each of the trays 56 and 58 have upwardly and outwardly inclined extensions 56*a* and 58*a* with respective inclined guides 56*b*, 58*b* along the top edges of the extensions. Tray 58 has downwardly extending sliders 58*c* which grip the guides 56*b* of tray 56 so that tray 58 can slide upwardly and outwardly with respect to tray 56 into the cantilevered open position shown in FIG. 4. A suitable stop, not shown, may be provided to prevent the tray 58 from being pulled off tray 56. By making the guide 56*b* upwardly inclined, vertical separation of the trays 56 and 58 is provided when the trays are opened to improve access to tray 56. Similarly, however, the trays could have horizontal guides if vertical separation between the trays is not required.

Topmost tray 60, which is absent the sidewall extensions, has downwardly projecting sliders 60*c* which grip the guides 58*b* of tray 58 so as to allow sliding of tray 60 to the open cantilevered position in like manner to tray 58. Again, a suitable stop, not shown, may be provided to prevent pulling off of tray 6.

Figure 5:
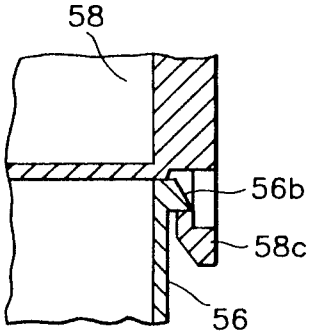
FIG. 5 is a sectional view on line 5—5 of FIG. 3.
Figure 6:
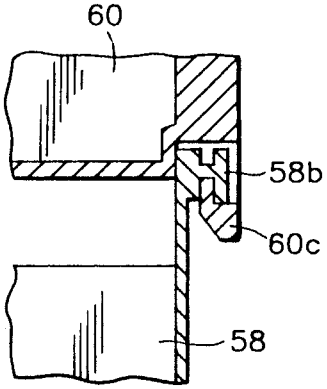
FIG. 6 is a sectional view on line 6—6 of FIG. 4.
Figure 7:
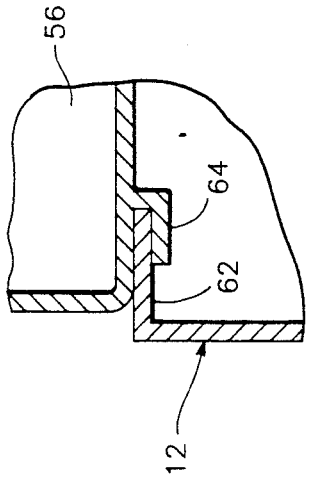
FIG. 7 is a sectional view on line 7—7 of FIG. 4.

As shown in FIG. 6, the main length of guide 58*b* (guide 56*b* is similar) has a channel shaped cross-section with slider 60*c* fitting in the channel. As shown in FIG. 5, however, the forward end section of guide 58*b* is substantially trapezoidal shaped and guide 56*b* being of similar configuration at its forward end. This arrangement allows the trays to be separated, and snapped together when in the closed nested position due to a degree of resilience in the slides 58*c* and 50*c*.

Figure 3:
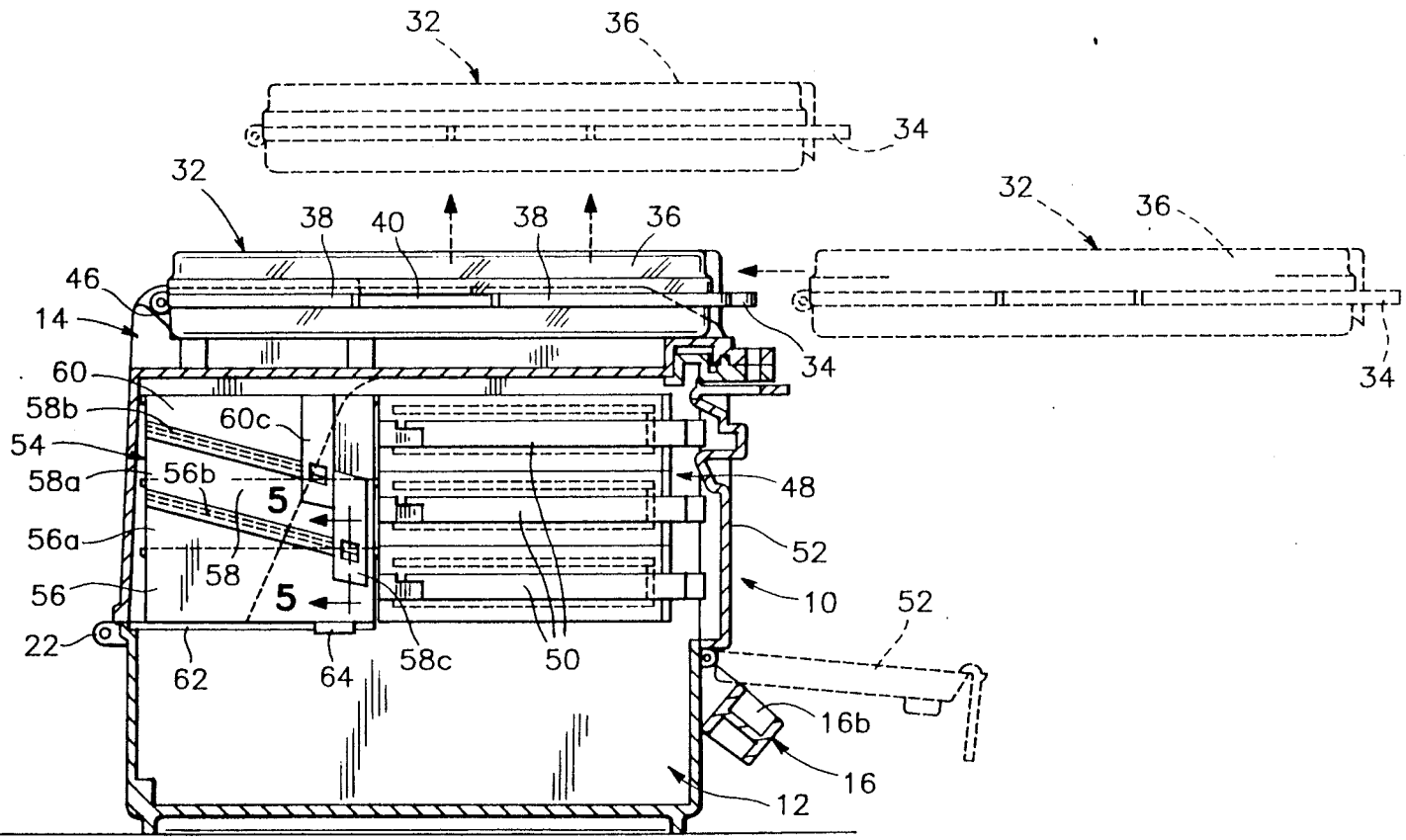
FIG. 3 is a sectional elevation.

It is evident from the above that the tray stack 54 can be extended from the nested configuration shown in FIG. 3 to the extended cantilevered configuration shown in FIG. 4 by outward sliding of the trays 60 and 58. Also, tray 56 can slide in and out on runners 52 to provide access to the lower portion of the box body.

I claim:

1. A portable box structure comprising a box body with a hinged lid, a bail-type handle having arms pivotally connected to opposite side walls of the body, a hinge connection between the lid and a back wall of the box body, projections on opposite side walls of the lid and corresponding lugs on said arms of the handle for engaging over said projections and preventing the lid from opening when the handle is in an upright box-carrying position, stops extending from the side walls of the lid for engaging the respective lugs and arresting the handle in a storage position when the handle is moved from the box-carrying position rearwardly towards said hinge connection and elongate tracks on the side walls of the lid extending between the respective projections and stops, the lugs travelling over said tracks when the handle is moved from the box-carrying position to the storage position and the tracks providing intereference with the lugs preventing the lid from opening whereby the lid can be opened only when the handle is moved forwardly from the box-carrying position to disengage the lugs from the projections.

2. The structure as defined in claim 1 wherein each track is formed along a rim of the lid.

3. The structure as defined in claim 2 wherein the side walls of the lid each have a shallower front portion, a deeper back portion and a substantially S-shaped rim and wherein the sidewalls of the box body each have a deeper front portion, a shallower back portion and a rim conforming substantially to the rim on the lid.

* * * * *